United States Patent [19]

Brown

[11] Patent Number: 4,787,174

[45] Date of Patent: Nov. 29, 1988

[54] CHILD SAFETY GATE

[76] Inventor: Tyrone Brown, 15338 Hastings Dr., Dolton, Ill. 60419

[21] Appl. No.: 58,551

[22] Filed: Jun. 5, 1987

[51] Int. Cl.[4] ..... E06B 7/00

[52] U.S. Cl. ..... 49/55; 49/57

[58] Field of Search ..... 49/50, 55, 57, 463; 52/67; 160/374, 372, 222, 223, 225

[56] References Cited

U.S. PATENT DOCUMENTS

| | | | |
|---|---|---|---|
| 181,318 | 8/1876 | Davis | 160/372 |
| 3,000,063 | 9/1961 | Hoog | 49/55 |
| 3,239,271 | 3/1966 | Bergersen | 108/159 |
| 4,492,263 | 1/1985 | Gebhard | 160/222 |
| 4,607,455 | 8/1986 | Bluem et al. | 49/55 |

*Primary Examiner*—Kenneth J. Dorner
*Assistant Examiner*—Gerald A. Anderson
*Attorney, Agent, or Firm*—Thomas W. Tolpin

[57] ABSTRACT

A sturdy, effective and economical portable barrier is provided to safely restrain and protect babies, toddlers and pets. The safety barrier comprises spring-biased decorative panels which expand to securely engage a door frame contract to a compact compressed position.

9 Claims, 1 Drawing Sheet

CHILD SAFETY GATE

BACKGROUND OF THE INVENTION

This invention relates to gates and, more particularly, to safety gates for small children.

Conventional child gates have interlocking diagonal bars and slats which open in a scissors-like accordian-style fashion to an expanded position. When open and in use, the gates have a crisscross pattern of diagonal bars and diamond, rectangular or V-shaped openings and holes. These gates are flimsy, bulky, and unstable. They are usually unattractive. It is estimated that there are 15 million of these gates in use in the United States.

Conventional child gates can often be unsafe, causing injury or death to children. The gates are often connected to walls and door frames by hook and eye fasteners. Hooks are sharp and can cut a child's fingers. Because the gates are usually weak and wobble, many children can spread and contract sections of the gate. Children often get their fingers pinched in the gate when the gate is spread (expanded) or contracted. Children can break their hands, fingers or toes on the diagonal bars. Some children have climbed over the gate using the holes as foot-rungs, getting into trouble and defeating the purpose of the restraining gate. Other children have fallen off the gates. Many children have gotten their hands, feet, and head stuck in the holes of the gates. Such conditions can lead to sever pain, injury, choking, and death.

Over the years various gates, harnesses, and restraining devices have been suggested for restraining children. These prior art gates, harnesses, and restraining devices have met with varying degrees of success.

It is therefore desirable to provide an improved child safety gate which overcomes most, if not all, of the above problems.

SUMMARY OF THE INVENTION

An improved child safety gate is provided for restraining and protecting children and pets. The novel gate is effective, economical and safe. It is particularly useful for safely restraining, protecting and preventing passage of babies and toddlers. It is also useful for restraining pets such as dogs, cats, hamsters, gerbils, etc.

The novel child safety gate or toddler shield is portable and compact. It is easy to use and install and is attractive. It is strong and sturdy with excellent structural strength and mechanical integrity to readily support and restrain active children and large dogs.

The novel child safety gate can be easily removed and conveniently stored in a flat position. Desirably, it can be mass produced in a variety of sizes and colors to accommodate personal tastes and floor plans.

To this end, the novel child safety gate comprises a spring-biased barrier with decorative solid (imperforate) panels. The panels are slidably connected to each other in the absence of an exterior track to permit movement of the panels from a contracted storage position to an expanded engagement position. The barrier is equipped with springs to bias and urge the panels to their expanded engagement position. The ends of the panels preferably have an engagement member, such as a specially shaped rubber door stop, to firmly and matingly engage the door frame, wall, or other surface against which the barrier is being secured.

The front walls of the panels can have cushions or pads to safely cushion the impact of a baby or toddler bumping their head against the panels. The cushions or pads can be made of resilient acoustical insulation material, such as foam rubber or impact-resistant plastic, to dampen and quiet repetitive banging of the panel by a toddler.

A more detailed explanation of the invention is provided in the following description and appended claims taken in conjunction with the accompanying drawings.

DETAILED DESCRIPTION OF THE PREFERRED EMBODIMENT

A portable spring-biased barrier and safety device 10 provides a barrier-wall assembly and child safety gate to safely restrain, protect and prevent passage of small children, such as infants and toddlers. It can also be used to restrain and prevent passage of pets, such as dogs. The barrier and safety device, which is also referred to as a toddler shield, is preferably made and fabricated out of sheet metal, such as light weight aluminum or stainless steel. Wood, impact-resistant plastic, or composite materials can also be used.

Figure 1:
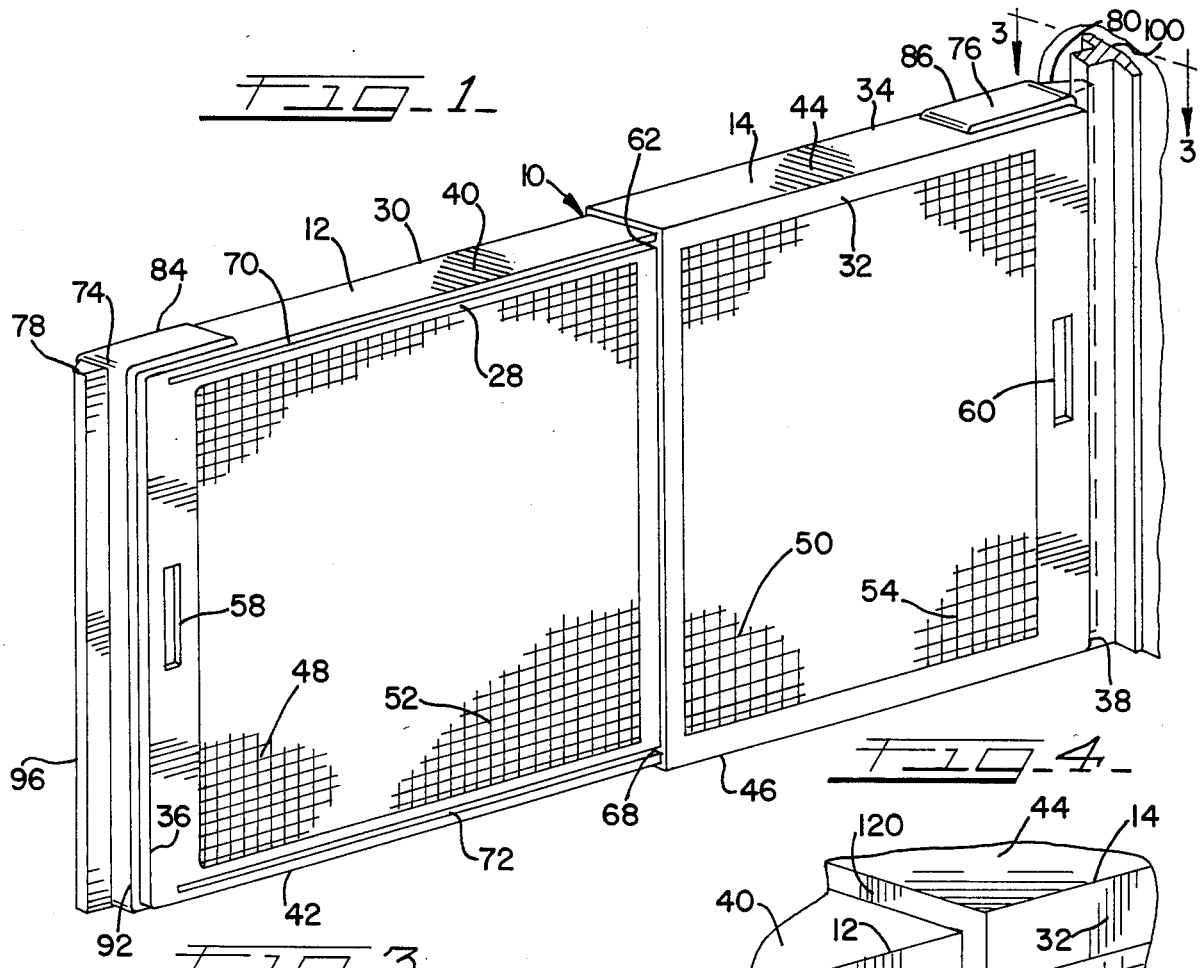
FIG. 1 is a perspective view of child safety gate in accordance with principles of the present invention.
Figure 3:
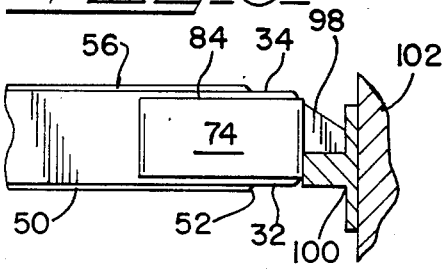
FIG. 3 is a cross-sectional view of the child safety gate taken substantially along lines 3—3 of FIG. 1.

The barrier has a pair of decorative slidable panels 12 and 14 (FIG. 1). The panels are symmetrical, complementary, and mirror images of each other except as mentioned below. As shown in FIG. 3, each of the panels are elongated and has an open-ended compartment 16 or 18 with an open end 20 or 22 which faces the other panel. The open-ended compartments provide spring-containing chambers to house, enclose and receive compression springs 24–26.

One of the panels 14, (the right panel) is slightly larger than the other panel 12 to telescopically receive, ride upon, and slide over the inward portion of the other panel. The open-ended compartment 18 (FIG. 3) of the larger panel provides a panel-receiving pocket or socket to telescopically receive and matingly engage the inward plug 16 of the other panel. The other panel 12 (the left panel) is slightly smaller than the right panel 14 to telescopically engage and slide within the inward panel-receiving pocket 18 of the right panel. The open-ended compartment of the smaller panel provides a rectangular-shaped tubular plug and annular coupler 16 which provides a slidable connector that is slidably connected, matingly coupled, telescopically engaged, and reciprocatingly moveable within the panel-receiving 18 pocket of the larger panel. The larger panel is sometimes referred to as the major panel. The smaller panel is sometimes referred to as the minor panel.

Each panel has decorative imperforate solid rectangular walls. As shown in FIG. 1, these walls include upright parallel, front and back longitudinal walls 28, 30, 32, and 34, vertical outer end walls 36 and 38, and horizontal parallel, top and bottom lateral walls 40, 42, 44, and 46. The end walls of each panel extend perpendicular between and connect the outer vertical edges and attached ends of the front and back walls of that panel. The top walls of each panel extend laterally (horizontally) between and are positioned perpendicular to and connects the top horizontal edges and upper portions of the front, back and end walls of that panel. The bottom walls of each panel extend laterally between, are positioned perpendicular to, and connect the bottom horizontal edges and lower portions of the front, back, and end walls of that panel.

The front and back walls provide child-impermeable, pet-impervious, upright barriers to safely restrain and block passage of babies, toddlers, and pets therethrough. The outer front surface of each front wall can have a resilient protective pad or elastic foam cushion 48 or 50 which is detachably or fixedly connected to the front surface of that wall, by snaps or other fasteners, to cushion the impact and striking of a child's head, hand, or leg against the panel. The pad or cushion can contain and be stuffed with acoustical insulation material, such as foam rubber or foamed plastic, to acoustically dampen and quiet repetitive banging or hitting of the panel by the child. The pad or cushion has a decorative fabric cover 52 or 54, made of chemically treated flame-resistant cotton, polyester, or other material. The cover and walls can be of various aesthetically pleasing, decorative, ornamental designs and colors. The outer surfaces of the back walls can also have similar pads or cushions 56 (FIG. 3) attached thereto, if desired.

The outer portions of the front and back walls of the panels have upright oblong, elongated centrally positioned, recessed handholds 58 and 60 (FIG. 1) which provide manually graspable (grippable) handles. The handles facilitate handling, gripping, removal, lifting, transport and carrying of the panels. The handles also help accommodate manual inward contraction of the panels.

Figure 4:
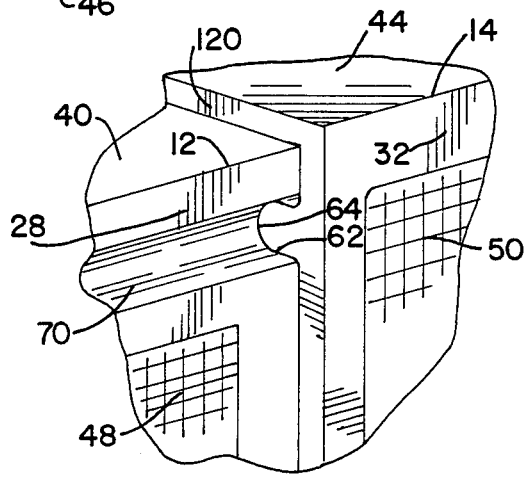
FIG. 4 is an enlarged fragmentary cross-sectional view of the upper connecting portions of the panels of the child safety gate.

As best shown in FIG. 4, an upper elongated horizontal rail or tongue 62 extends longitudinally across and laterally inwardly from the upper portion of the inner surface of the front wall of the larger right panel, at a location near the top edge of the front wall. The tongue has a convex curved rounded head 64 which extends laterally inwardly. A similar lower elongated horizontal rail or tongue 68 (FIG. 1) extends longitudinally across and laterally inwardly from the lower portion of the inner surface of the front wall of the larger right panel at a location near the bottom edge of the front wall. The inner surface of the back wall of the larger panel can have similar corresponding upper and lower rails or tongues.

As shown in FIG. 4, the outer front surface of the upper portion of the front wall of the smaller left panel has an upper elongated concave slot, channel, or groove 70, which extends horizontally and longitudinally across the front wall of the smaller panel near the top edge of the front wall of the smaller panel, to slidably receive and matingly engage the upper tongue or rail of the front wall of the larger panel. The front surface of the lower portion of the front wall of the smaller left panel has a similar, lower elongated concave slot, channel, or groove 72 (FIG. 1), which extends horizontally and longitudinally across the front wall of the smaller panel near the bottom edge of the smaller panel, to slidably receive and matingly engage the lower tongue or rail of the front wall of the larger panel. The outer back surface of the back wall of the smaller panel can have similar corresponding upper and lower slots, channels, or grooves which slidably receive and matingly engage the upper and lower tongues or rails, respectively, of the back wall of the larger panel.

The tongues (rails) and grooves, channels, or slots, facilitate smooth reciprocal sliding of the panels and serve as a slidable connector, coupling and internal longitudinal tracks to connect and couple the panels.

A [-shaped bumper and guard 74 and 76 (FIG. 2) is connected to each end wall to protect and prevent the end, top and bottom walls, as well as the door frame or other surface to which the barrier is being secured, from being marred and scratched. The bumper and guard has an upright main body door-frame, engaging portion 78 or 80 which lies against and covers the outer face 81 or 82 of the end wall, an upper horizontal portion 84 or 86 which lies against and covers an outer portion of the top wall near the upper outer corner of the panel, and a lower horizontal portion 88 or 90 which lies against and covers an outer portion of the bottom wall near the lower outer corner of the panel. The upper and lower portions of the bumper and guard are generally planar or flat and extends from the outer corner from about 5% to 80%, and preferably from about 15% to 20%, of the length or span of the top and bottom walls.

The upright main body portion 78 or 80 (FIG. 2) of the bumper and guard has a generally planar or flat vertical engagement section 92 or 94 and a vertical, trapezoidal engagement section 96 or 98 which extends outwardly from the flat engagement section. As shown in FIG. 3, the trapezoidal and flat sections are shaped and arranged complementary to a door jamb 100 or upright portion of a door frame 102. The trapezoidal and flat sections cooperate with each other to provide a door-frame engagement portion to snugly wedge and abut against and matingly engage the door jamb or upright portion of the door frame to enable the barrier to span across and be secured by the tension forces of the springs against the door frame.

The bumpers and guards can be attached to the end, top and bottom walls by glue or fasteners. The bumpers and guards provide heavy duty stops which are preferably made of a resilient elastomeric material, such as rubber or silicon, to help cushion and matingly engage the door frame.

The edges and corners of the bumpers, walls, and panels are preferably rounded or filleted for safety reasons to prevent injury to children and pets which might otherwise occur with sharp edges and corners.

Figure 2:
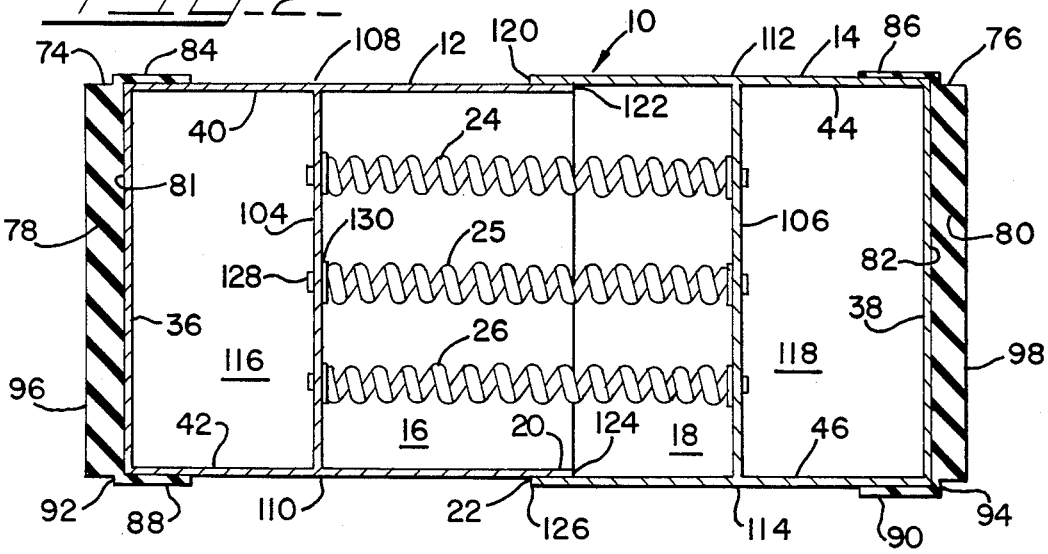
FIG. 2 is a reduced cross-sectional front view of the child safety gate.

As shown in FIG. 2, each panel has a vertical intermediate reinforcing strut 104 or 106 which extends between, reinforces and connects the intermediate middle portions 108, 110, 112, and 114 of the front and back walls of the panel. The struts are parallel to the end wall and divides the interior of the panels into outer box-shaped compartments 116 and 118 and inner open-ended spring-containing compartments 16 and 18. The open-ended spring-containing compartments includes the middle portions and unattached cantilevered portions 120, 122, 124, and 126 of the top and bottom walls. The open-ended compartments of the two panels face each other and telescopically engage and fit within and about the other to provide an enclosed spring-containing chamber (spring-receiving compartment) bounded by the struts.

Three parallel compression springs 24–26 extend longitudinally between and connect the struts by bolts 128, washers 130, or other fasteners. The springs bias and urge the panels to move telescopically outwardly to an expanded engagement position to securely engage the barrier against a door frame or other surface during installation and use.

The springs, struts, and upper portions of the bumpers provide limit stops to limit the collapse and contraction of the panels. The springs and spring forces also provide a limit stop which controls and limits the expansion of the panels. The springs and fasteners further connect and couple the panels together.

In use, the portable barrier and child safety gate is carried to the door frame to which it is being installed and secured. The barrier is placed in an upright installation position and manually compressed (squeezed) inwardly via the handles on the panels, to move the panels telescopically inwardly to a contracted position so that the maximum span of the panels is less than the opening of the door frame. The barrier is then positioned so that the door frame-engaging portions are aligned with their complementary sections of the door jamb or upright portions of the door frame. Upon alignment, the installer removes her hands from the gate to release the compression force, which causes the panels to move telescopically outwardly upon the action, urging and biasing tensile forces of the compression springs, so the the door frame-engaging portions securely wedge against and lockably engage the door frame. The installed barrier provides a secure, strong, dependable, and stable barrier wall and safety device.

In order to remove the barrier and safety device from the door frame, the handles are grasped and the panels are manually compressed (squeezed) longitudinally inwardly towards each other to move the panels telescopically inwardly to their contracted position, so that the panels are compressed and span a distance less than the door frame-opening. The barrier is then removed, released, and transported to a closet or other place for storage.

In one test unit, the barrier had an expanded uncompressed width and span of 40 inches, a contracted compressed width and span of 30 inches, a height of 38 inches, and a thickness of 3 inches. Three springs were used with a free length of 12 inches and a spring force of 2190 lbs per pcs.

Barriers and child safety gates of other sizes, dimensions, and spring lengths, and other spring forces can be used, if desired. More or fewer springs can also be used to attain the desired spring force.

While the illustrated barrier is preferred for best results, in some circumstances, it may be desirable to use one or more flat or different shape door-frame engaging portions to engage a door frame, wall, or other surface or to use more than two panels. Knobs, rings, or other shaped handles can be used.

Among the many advantages of the novel barrier and child safety gate are:

1. Simple installation.
2. Easy to use.
3. Strong construction.
4. Aesthetically pleasing and nice appearance.
5. Excellent for babies, toddlers, and pets.
6. Effective.
7. Economical.
8. Sturdy; and
9. Safe.

Although embodiments of the invention have been shown and described, it is to be understood that various modifications and substitutions, as well as rearrangements of parts, components, proportions, and dimensions, can be made by those skilled in the art without departing from the novel spirit and scope of this invention.

What is claimed is:

1. A child safety gate for restraining and protecting children and pets, comprising:

a first elongated, open-ended, slidable panel having a substantially imperforate rectangular solid first front wall with an attached end, an unattached cantilevered end, a middle portion, a top edge, and a bottom edge;

a substantially imperforate rectangular solid second back wall with an attached end, an unattached cantilevered end, a middle portion, a top edge, and a bottom edge;

said first front and first back walls being aligned and in substantial parallel relationship to each other and cooperating with each other to provide a first substantially child-impermeable upright barrier for safely restraining and blocking passage of babies and toddlers;

a substantially vertical first end wall extending substantially perpendicular between and connecting said attached ends of said first front and first back walls, said end wall having a top edge and a bottom edge;

a first resilient upright door frame-engaging portion connected to and extending outwardly from said first end wall for matingly engaging and abutting against a door jamb;

a first intermediate reinforcing strut extending between, reinforcing, and connecting said middle portions of said first front and back walls, said first strut being substantially parallel to said first end wall;

a first top wall extending laterally between and connecting the top edges of said first front, back and end walls;

a first bottom wall extending laterally between and connecting the bottom edges of said first front, back and end walls, said first bottom wall being substantially parallel to said first top wall and substantially perpendicular to said first end wall; and said unattached cantilevered ends and middle portions of said first front and first back walls cooperating with said first strut and said first top and bottom walls to form a panel-receiving pocket and a first spring-containing chamber;

a second elongated, open-ended, slidable panel being slightly smaller than said first panel for telescopic sliding engagement with said first panel, said second elongated, open-ended, slidable panel having a substantially imperforate rectangular solid second front wall with an attached end, an unattached cantilevered end, a middle portion, a top edge, and a bottom edge;

a substantially imperforate rectangular solid second back wall with an attached end, an unattached cantilevered end, a middle portion, a top edge, and a bottom edge;

said second front and second back walls being aligned and in substantial parallel relationship to each other and cooperating with each other to provide a second substantially child-impermeable upright barrier for safely restraining and blocking passage of babies and toddlers;

a substantially vertical second end wall extending substantially perpendicular between and connecting said attached ends of said second front and second back walls, said second end wall having a top edge and a bottom edge;

a second resilient upright door frame-engaging portion connected t and extending outwardly from said second end wall for matingly engaging and abutting against a portion of a door frame opposite said door jamb;

a second intermediate reinforcing strut extending between, reinforcing, and connecting said middle portions of said second front and back walls, said second strut being substantially parallel to said second end wall;

a second top wall extending laterally between and connecting the top edges of said second front, back and end walls;

a second bottom wall extending laterally between and connecting the bottom edges of said second front, back and end walls, said second bottom wall being substantially parallel to said second top wall and substantially perpendicular to said second end wall; and said unattached cantilevered ends and middle portions of said second front and first back walls cooperating with said second strut and said second top and bottom walls to form a second spring-containing chamber and an open-ended plug for slidably, telescopically, and matingly engaging said panel-receiving pocket of said first panel; and a plurality of compression springs positioned in said spring chambers and extending longitudinally between and connected to said first and second struts for urging said first and second panels to move telescopically outwardly to an expanded engagement position to securely engage said safety gate against said door frame upon installation and use, and said springs being compressible when said panels are squeezed longitudinally towards each other with a preselected minimum force for moving said panels telescopically inwardly to a contracted compressed position to release and remove said safety gate from said door frame.

2. A child safety gate in accordance with claim 1 wherein:

said front and back walls of one of said panels have upper longitudinal tongues in proximity to said top edges, and said front and back walls of said other panel define upper longitudinal grooves for slidably receiving said upper longitudinal tongues.

3. A child safety gate in accordance with claim 2 wherein:

said front and back walls of one of said panels have lower longitudinal tongues in proximity to said bottom edges, and said front and back walls of said other panel define lower longitudinal grooves for slidably receiving said lower longitudinal tongues.

4. A child safety gate in accordance with claim 1 wherein said edges comprise rounded edges.

5. A child safety gate in accordance with claim 4 wherein said panels each have a a manually grippable handle for carrying and facilitating manual contraction of said telescoping panels.

6. A child safety gate in accordance with claim 5 including fastening means for attaching said springs to said struts.

7. A child safety gate in accordance with claim 1 wherein said top and bottom walls of said panels have resilient bumpers.

8. A child safety gate in accordance with claim 1 wherein said panels have protective acoustic pads connected to and extending laterally outwardly from said front walls for cushioning the impact of a child's head, hand or leg and for acoustically dampening and quieting impact of said front wall by said child.

9. A child safety gate in accordance with claim 8 wherein said panels have decorative fabric covering said protective acoustic pads.

* * * * *